United States Patent [19]

Asten et al.

[11] Patent Number: 4,715,903

[45] Date of Patent: Dec. 29, 1987

[54] ALUMINUM OFFSET COIL, AND METHOD FOR ITS PRODUCTION

[75] Inventors: Wolfgang V. Asten, Pulheim; Karl H. Dorner, Grevenbroich; Hartmut Scheel, Grevenbroich; Volker Wurstle, Grevenbroich, all of Fed. Rep. of Germany

[73] Assignee: Vereinigte Aluminium-Werke Aktiengesellschaft, Fed. Rep. of Germany

[21] Appl. No.: 835,559

[22] Filed: Mar. 3, 1986

[30] Foreign Application Priority Data

Mar. 2, 1985 [DE] Fed. Rep. of Germany ..... 3507402

[51] Int. Cl.[4] ..... C22F 1/04

[52] U.S. Cl. ..... 148/11.5 A; 148/437; 148/438; 148/439; 148/440

[58] Field of Search ..... 148/11.5 A, 2, 437, 148/438, 439, 440

[56] References Cited

U.S. PATENT DOCUMENTS 3,716,419 2/1973 Boutin ..... 148/11.5 A

*Primary Examiner*—R. Dean
*Attorney, Agent, or Firm*—Darby & Darby

[57] ABSTRACT

An aluminum offset coil, having a surface zone of a predominantly recrystallized globular, fine grain structure, and a core zone of a greatly work-hardened structure, for use in offset printing plates, and a process for its preparation.

7 Claims, No Drawings

ALUMINUM OFFSET COIL, AND METHOD FOR ITS PRODUCTION

BACKGROUND OF THE INVENTION

This invention relates to offset coils and more particularly to aluminum offset coils having a predominantly recrystallized globular and subsequently cold-deformed structure.

In the production of offset printing plates, rolled coils and sheets of aluminum or aluminum alloys having a thickness in the range of about 0.1 to 0.5 mm are used. In subsequent processing, the aluminum coil is provided with a photo-sensitive layer which is transformed by the action of light, thus rendering it insoluble in the developers used. By the end of the developing stage, an uncoated aluminum surface having hydrophilic properties is created in the unexposed areas of the coil.

The developed printing plate is clamped on a plate cylinder for the printing process. It is desired that the offset printing plates possess sufficient strength and resistance to crack formation, when subjected to mechanical stress.

To obtain a print edition of the highest possible quality, the rolled surface must be roughened either mechanically, electrochemically or chemically for better adhesion between the coil and the photo-sensitive layer. The roughening should be conducted so as to achieve a homogeneous and fine-celled surface.

To increase the quality of the color print edition, it if further desired to subject the developed support layer to a thermal process which results in the hardening of the remaining layer parts (image carrier). This thermal treatment is carried out at such temperatures that a distinct decrease in the strength of the aluminum is often brought about.

The above-described requirements for an offset coil could heretofore be met only with expensive technology. According to DE-OS No. 19 29 146 it has been proposed to clad a layer of pure aluminum on both sides of a core made of a pliant aluminum-magnesium-manganese alloy of high tensile strength. The cladded aluminum layer has a thickness of 2–16% (based on the total thickness of the core material) on each side of the core. This process provides enhanced strength properties along with favorable behavior on roughening. However, this process is extremely expensive.

SUMMARY OF THE INVENTION

It is an object of the present invention to further improve, in a cost-efficient manner, the strength and elongation values and, in particular, the thermal stability and rigidity, in the above-described offset coils, while simultaneously preserving the suitability of the surface for subsequent electrochemical roughening. It is a further object of the present invention to provide a simplified method for the production of such offset coils. The invention, therefore, provides an aluminum offset coil, having a surface region of a predominantly recrystallized globular and then cold-deformed structure, yet a distinct, fine grain structure, and a core region of a greatly work hardened structure.

In accordance with the present invention, an offset coil is provided with a recrystallized globular and then cold-deformed structure, said coil comprising:

an aluminum core zone comprising a grain structure elongated in the rolling direction;

an aluminum surface zone, said surface zone being formed parallel to the rolling direction and comprising a globular recrystallized structure with an aspect ratio S of less than 8.

Another aspect of the present invention is directed to a method for making an offset coil comprising:

hot-rolling an aluminum billet having a thickness between 400 and 600 mm at a temperature within the range of 550°–480° C. thereby forming a hot-rolled coil, such that the temperature of the hot-rolled coil is above 320° C. and its thickness is less than 3.5 mm;

cooling said coil to room temperature;

cold-rolling said coil, to achieve a thickness reduction for said coil of about 80–90% based on the thickness of the hot-rolled coil.

DETAILED DESCRIPTION OF THE INVENTION

The selected texture composition according to the present invention allows for the preparation of an offset coil meeting all of the above requirements in an optimal manner without need to resort to cladding. As a result of the distinctly less deformed grain structure of the surface layer, a mechanical or electrochemical roughening of the printing plate is possible, resulting in a homogeneous and fine roughened topography. The elongated rolling structure present in the core provides the required strength when subjecting the plate to thermal treatment.

In the process for the production of the offset coil according to the present invention, the hot rolling output temperature of the coil should be greater than 320° C. Moreover, the thickness reduction in the hot rolling should be high: from 400–600 mm to less than 3.5 mm, and the cold rolling to final thickness should be achieved without intermediate annealing. A reduction in cold rolling-thickness of from about 80 to 90% should be achieved.

A conventional rolling mill may be used in achieving the hot and cold rolling operation parameters as provided in illustrative Example 1.

The thermal control provided for the process of the invention permits the outer layer of the coil to recrystallize with the formation of a globular grain structure. Thermal control is achieved by regulating both the rate of cooling and the rolling speed of the hot rolling mill. It is preferred that the speed of the mill be regulated between 5 m/sec and 10 m/sec. The grain sizes in the outer layer range from 100 to 36 square micrometers, which corresponds to 5000 to 1000 grains per $mm^2$. The structure is homogeneous and may be termed fine-grain.

The hot rolling process is controlled according to the invention in such a way that recrystallization does not occur over the total cross section of the offset coil, but instead is limited to the surface zones. This results in formation of a nonrecrystallized core zone having a elongated rolling structure which enhances the mechanical properties in the coil. Numerous tests have shown that providing an electrochemically roughened surface region with 10 to 30%, and preferably about 15% of globular structure, is sufficient. The subsequent cold rolling elongates the globular grain structure of the coil but the surface zones show a relatively low grain aspect ratio compared to that in the core zone. Grain aspect ratios may be calculated by the following equation:

$$\text{Grain Aspect Ratio } S = \frac{\text{length of grain}}{\text{width of grain}}$$

The offset coil preferably has grain aspect ratio values of $S<8$ in the surface zone, and $S \geqq 16$ in the core zone. The evaluation method as provided in "Zwei neve Schnellverfahren zur Kornquerschmittsbestimmung" by R. Dederichs and H. Kostron, published in 1950 by Verlag Chemil Weinheim, was employed to determine the aspect ratio values. The disclosure of this reference is incorporated by reference.

The invention is described more specifically by reference to the following examples, which are intended to illustrate the present invention without limiting its scope:

EXAMPLE 1 (PRESENT INVENTION)

Material: Pure aluminum Al 99.5%
Hot rolling temperature: 550° to 480° C.
Hot rolling end temperature: 325° C.
Billet thickness: 600 mm
Hot rolled thickness: 2.8 mm
Intermediate annealing temperature: —
Cold rolling end thickness: 0.28 mm
Ultimate tensile strength Rm: 181 $N/nm_2$
Yield point Rp 0.2: 163 $N/mm^2$
Elongation A 50: 2.9%

EXAMPLE 2 (STANDARD MANUFACTURE FOR COMPARISON)

Material: Pure aluminum Al 99.5%
Hot rolling temperature: 550° to 480° C.
Hot rolling end temperature: 290° C.
Billet thickness: 600 mm
Hot-rolled thickness: 4.2 mm
Cold rolling to: 2.8 mm
Intermediate annealing temperature: 350° C.
Cold rolling end thickness: 0.28 mm
Ultimate tensile strength Rm: 163 $N/mm^2$
Yield point Rp 0.2: 149 $N/mm^2$
Elongation A 50: 1.8%

The offset coils produced according to Examples 1 and 2 were subjected to a thermal treatment at temperatures of 240° C. for 15 minutes. This gave the following strength values:

EXAMPLE 1

Tensile strength Rm: 106 $N/mm^2$
Yield point Rp 0.2: 89 $N/mm^2$
Yield point ratio Rp 0.2: Rm=84%

COMPARISON EXAMPLE 2

Tensile strength Rm: 89 $N/mm^2$
Yield point Rp 0.2: 50 $N/mm^2$
Yield point ratio Rp 0.2: Rm=56%

The foregoing examples show that the method of the present invention provides an offset coil with very favorable mechanical properties, and surfaces suitable for electrochemical roughening. The addition of from about 0.03 to 0.4% of magnesium, from about 0.05 to 0.25% beryllium and from about 0.05 to 0.25% copper, improves the mechanical properties since the decrease in strength, which generally accompanies a thermal treatment at more than 200° C., occurs later and to a much lesser degree. The yield point ratio is a measure of the rigidity of the plates. In order to handle offset plates conveniently, and in particular thin plates, the rigidity must be sufficiently high. Thus, the offset coil produced according to the present invention is superior to that previously used. The coils of the prior art have insufficient rigidity after being subjected to the thermal treatment which is customarily employed in the productin of offset printing plates.

The invention has been described above by reference to particularly preferred embodiments. However, it will be clear to those skilled in the art that many additions, deletions and modifications are possible without departure from the scope of the invention as described above and claimed below.

What is claimed is:

1. An offset coil made of aluminum having a recrystallized globular and cold-deformed structure, said coil comprising:

a core zone comprising an unrecrystallized grain structure having a rolling structure elongated in the rolling direction;

a surface zone, said zone being formed parallel to the rolling direction and comprising a recrystallized globular grain structure with a grain aspect ratio S of less than 8.

2. The coil of claim 1, wherein said core zone has a grain aspect ratio S of at least 16.

3. The coil of claim 1, wherein said aluminum comprises a component selected from the group consisting of magnesium in an amount ranging between about 0.03 and about 0.4%, beryllium in an amount ranging between about 0.05 and about 0.25% and copper in an amount ranging between about 0.05 and about 0.25%, and mixtures thereof.

4. The coil of claim 1, 2 or 3 wherein said surface zone constitutes from about 10 to about 30% of the total cross section of said coil.

5. A method of making an offset coil comprising:

hot-rolling an aluminum billet having a thickness between about 400 and about 600 mm at a temperature within the range between about 550° and about 480° C., thereby forming a coil having a recrystallized surface zone and an unrecrystallized core zone such that the coil after hot-rolling has a temperature above about 320° C. and has a hot-rolled thickness less than about 3.5 mm;

cooling said coil to room temperature;

cold rolling said coil without intermediate annealing to achieve a thickness reduction of about 80 to about 90% compared to the thicnkess of the hot rolled coil, such that said core zone has a grain aspect ratio S of at least 16 and said surface zone has a grain aspect ratio S of less than 8.

6. The method of claim 5 wherein the hot-rolled thickness of said coil is between about 2.5 and about 3.5 mm.

7. The method of claims 5 or 6 wherein said aluminum billet comprises an ingredient selected from the group consisting of between about 0.03 and about 0.4% of magnesium, between about 0.05 and about 0.25% of copper, and between about 0.05 and about 0.25% of beryllium, and mixtures thereof.

* * * * *